United States Patent [19]

Carternock

[11] Patent Number: 4,592,696

[45] Date of Patent: Jun. 3, 1986

[54] MATERIAL WORKING MACHINES

[75] Inventor: Frederick A. Carternock, Folkestone, United Kingdom

[73] Assignee: Pulsar International Limited, Guernsey, Channel Islands

[21] Appl. No.: 466,345

[22] PCT Filed: May 28, 1982

[86] PCT No.: PCT/GB82/00155

§ 371 Date: Feb. 1, 1983

§ 102(e) Date: Feb. 1, 1983

[87] PCT Pub. No.: WO82/04274

PCT Pub. Date: Dec. 9, 1982

[30] Foreign Application Priority Data

Jun. 1, 1981 [GB] United Kingdom ..... 8116624

[51] Int. Cl.[4] ..... E02F 3/42

[52] U.S. Cl. ..... 414/685; 414/722; 414/694; 37/DIG. 18

[58] Field of Search ..... 37/DIG. 18; 414/685, 414/694

[56] References Cited

U.S. PATENT DOCUMENTS 1,939,289 12/1933 Baker .
2,986,294 5/1961 Granryd .
3,443,327 5/1969 Martin .
3,677,426 7/1972 Luck .
3,762,481 10/1973 Allen et al. .

*Primary Examiner*—Terrance L. Siemens
*Attorney, Agent, or Firm*—Berman, Aisenberg & Platt

[57] ABSTRACT

In a material working (e.g. penetrating, loading, compacting) machine the power and machine weight needed to achieve a given performance can be reduced by making one (50) of two pivots (34, 50) at which a working implement such as a bucket 14 is supported an eccentric pivot and driving it by means of a motor (36). The circular vibration of the bucket at pivot (50) combined with arcuate vibration which results and is permitted at pivot (34) by means of link (30), causes the working portion namely bucket teeth (56), to vibrate on a closed elongate curved path 58. This improves penetration and loading performance of the bucket without requiring excessive power to generate the vibrations.

17 Claims, 7 Drawing Figures

MATERIAL WORKING MACHINES

This invention relates to material working machines such as excavators, loaders, drills or breakers, and compactors having an implement for working on material in some way. Throughout this specification the term "working" on material is intended to encompass all forms of interaction of a working implement with material being worked on, for example, penetration, compaction, loading and transportation etc. of materials.

Commonly, material working machines comprise a "prime mover", which is some form of powered vehicle, to which is articulated support means carrying a working implement. A system of hydraulically powered rams mounted on booms is used to impart rotational and/or translatory movement to the working implement. Typical examples are back hoes in which the working implement is a bucket used to dig into the ground and towards the prime mover then lift excavated material out of the ground, and front loaders in which the working implement is also a bucket but is arranged to be driven generally horizontally into material then tilted and raised to lift the material collected. In use, such machines, especially earth working machines, may encounter very high resistance at the working implement and in "deadweight" machines this resistance must be overcome using forces generated by the rotational and/or translatory movement of the working implement, the available level of such forces being dependent on the weight of the prime mover, the support means and the working implement and the reach of the working implement. In deadweight back hoes, to achieve the same working capability but a longer reach, for example, it would be necessary to increase the weight of the prime mover to ensure penetration without the prime mover lifting instead. In deadweight front loaders, to achieve greater tractive effort to force the bucket into more resistive loads, it would be necessary to improve ground grip by increased weight of the prime mover and/or resorting to crawler tracks instead of ground wheels.

It is known to vibrate a working implement mounted on a material working machine.

In proposed forms of material working machines utilising vibrating bucket or blade type implements which penetrate the ground, a straight or slightly arcuate linear reciprocating movement is imparted to the portion of the working implement in contact with the material being worked but such "dynamic" arrangements have not in practice proved to be of very great advantage.

Straight reciprocation of a drilling spike is satisfactory for penetration but often the spike becomes wedged in the hole it has drilled.

Road rollers have been vibrated by means of mechanically rotated unbalanced weights but the resultant vibration of the roller is of an uncontrolled form and unsuited to other applications.

The present invention provides a material handling machine having means supporting an implement for working on material, the machine comprising a material working machine having means supporting an implement for working on material, the machine comprising means for vibrating the implement by applying a mechanically predetermined movement to the implement such that, in use, a portion of the implement for engaging material to be worked on describes a closed curve during each cycle of vibration. This form of vibration has the advantage that a higher frequency is obtainable for a given vibratory power input than with linear reciprocation, which wastes power due to the motion being discontinuous.

The resistance presented by the material being worked on is then much more easily overcome enabling the same working capability to be achieved using lighter equipment. Dynamic machines which are cheaper, lighter and have a longer reach can thus perform as well as deadweight machines which are heavier, more expensive and of shorter reach. When using the invention in certain machines, the tractive forces between the prime mover and the ground need not be as great as in deadweight machines which may enable, for example, wheels to be used instead of the crawler treads which would otherwise be necessary. Another advantage of machines utilising the invention is that suction problems, often encountered by earth working equipment when the ground material is wet, are reduced or avoided due to the motion of the working implement.

The present invention enables high frequency movement of the working portion of the working implement to be obtained due to the continuous nature of the motion imparted to the working implement. Frequencies as high as 170 Hertz can be obtained and a frequency above 8 Hertz is preferred.

Preferably the closed curve is of elongate form. With this preferred feature the vibratory movement of the working portion of the implement has directional characteristics which can be utilised to substantial benefit whilst enabling high frequency movement to be achieved, by arranging for the major dimension of the elongate curve to be at an appropriate angle.

For example, in one form of the invention, the support means and implement are in a back hoe configuration, the implement being a back-hoe bucket, and the closed curve described by the leading edge portion of the bucket is disposed with its major dimension at an acute angle, substantially less than a right angle, to the direction in which the leading edge portion of the bucket extends forwardly. Such an arrangement optimises the benefits of the vibration when a back hoe is being used to excavate in its normal manner, by reducing the resistance offered by the ground being excavated.

In another example the support means and implement are in a front loader configuration, the implement being a bucket, and the closed curve described by the leading edge portion of the bucket is disposed with its major dimension approximately perpendicular to the direction in which the leading edge portion of the bucket extends forwardly. This enables loosening and thus easier penetration of the material being loaded.

In a preferred embodiment of the present invention the vibrating means comprises an eccentric on a shaft and drive means are provided for rotating the shaft.

In some forms of material handling machines in which the working implement can be vibrated, forces which are used to effect rotational and/or translatory movement of the working implement are applied along the same path as forces which are used to effect vibratory movement of the implement. Thus the means for producing vibration of the working implement has to work against the other applied forces and in some cases against the entire weight of the machine.

According to another aspect of the present invention, we provide a machine having means supporting an implement for working on material, the machine being adapted to apply vibratory forces for vibrating the implement and also means for applying rotatory and/or translatory forces for effecting rotational and/or translatory movement of the implement wherein the vibratory forces are applied along a different path from at least the major rotatory and/or translatory forces.

This aspect of the invention has the advantage that the means for producing vibration of the working implement need be less powerful than previously required in known types of machine thereby saving on costs and materials.

With an elongate closed curve vibration path, the orientation of the major dimension of the path relative to the direction of the major rotatory and/or translatory forces may be arranged so as to enhance or achieve the same effect.

According to yet another aspect of the present invention we provide a machine comprising means supporting an implement for working on material wherein the implement is coupled to a driven eccentric and is caused to vibrate by rotation of the eccentric.

The support means will in many cases support the working implement through pivots which enable rotation of the implement, e.g. the bucket-loading movement of a back hoe or the bucket-tilting movement of a front loader, and the driven eccentric advantageously itself forms one of these pivots, thus having a dual function and reducing the cost of incorporating the invention into material working equipment of otherwise known design, since the driven eccentric simply substitutes for the usual coaxial pivot.

Preferably, the eccentric cooperates with a bearing fixed relative to the implement.

In connection with all three aspects of the present invention, preferably the support means pivotally supports the implement at at least two spaced positions, the vibrating means being arranged to apply vibration to the implement at one said position, and a control member of the support means being pivotally coupled to the implement at another said position so as to control the position of the implement while permitting said vibration.

Preferred embodiments of the present invention will now be described by way of example with reference to the accompanying drawings, in which.

Figure 1:
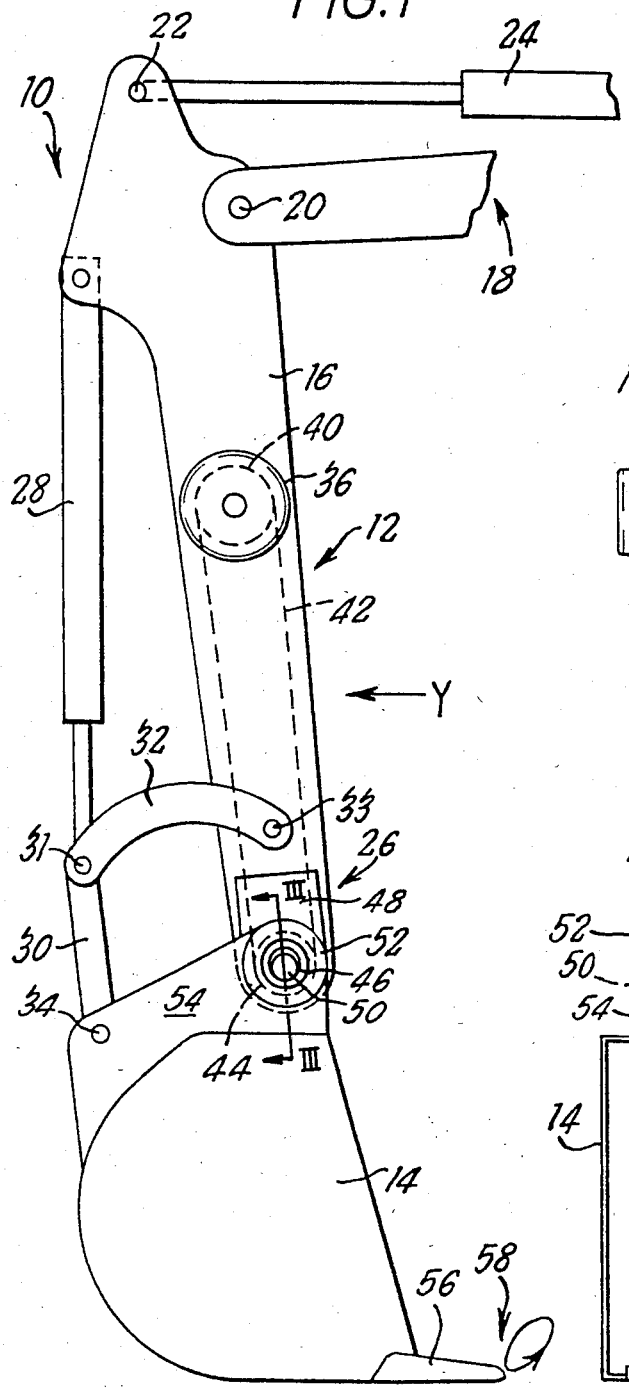
FIG. 1 is a side view of the relevant part of a material working machine according to the present invention incorporating an excavator penetrating and loading member which is a back hoe attached to a carrying vehicle (not shown) with a pivotal or slewing mount.

In FIG. 1, an excavator indicated generally at 10 forming part of a material working machine comprises support means indicated generally at 12 and a bucket 14. A main support 16 is pivotally connected to a pivotal boom structure 18 about pivots 20 and 22. A boom ram 24 is operable to lift and lower the bucket 14 by pivoting the main support 16.

A vibratory mechanism, indicated generally at 26, is mounted on the main support 16. A ram 28 operable to impose rotational movement of the bucket 14 is connected at pivot 31 to pivotal links 30 and 32. Link 32 is pivotally connected at pivot point 33 to the main support 16. The pivotal link 30, connected to the bucket 14 at pivot 34, is operable to control the position of the bucket 14 while permitting it to vibrate, as link 30 swings to and fro about pivot 31.

Figure 2:
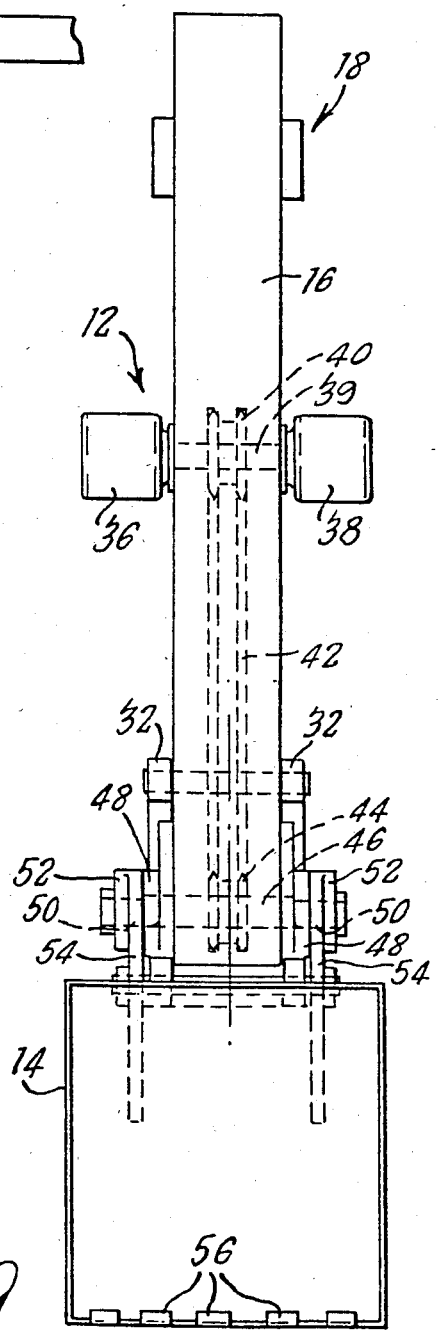
FIG. 2 is a front view of the excavator of FIG. 1 looking in direction Y.

Referring now both to FIG. 1 and to FIG. 2, the vibrating mechanism 26 comprises two aligned hydraulic motors 36 and 38 connected to a common shaft 39 having a drive sprocket 40 mounted thereon, which is connected by drive chain 42 to another drive sprocket 44. The sprocket 44 is mounted on a shaft 46 each end of which is sealed in an inner bearing housing 48. At each end of the shaft 46 is an eccentric portion 50 sealed in an outer bearing housing 52. The position of the bucket 14 is fixed in relation to the outer bearing housings 52 by means of rigid connecting portions 54.

The hydraulic motors 36, 38 drive the shaft 39 causing the drive sprocket 40 to rotate and this rotation is transmitted to the drive sprocket 44 via chain 42. The shaft 46 rotates causing the eccentrics 50 to describe a circular orbit (having a radius of less than 1 cm, and, for example, about 1 mm) around the axis of the shaft 46 thereby vibrating the bucket 14 in a manner which is controlled by line 30 connected to the link 32 and ram 28. With this arrangement, the eccentrics 50 cause the teeth 56 on the bucket 14 to describe a generally elliptical closed curve during each cycle of vibration. In FIG. 1 the motion of the teeth 56 is diagrammatically indicated at 58 showing that the major dimension of the elongate path is at an acute angle, substantially less than a right angle, to the direction in which the toothed leading edge portion of the bucket extends forwardly, which will be approximately the direction of incidence of the teeth 56 on the material to be penetrated. This configuration has two advantages. Firstly, throughout a substantial portion of the motion, the teeth are not acting against the weight of the machine behind them and, secondly, the resistance of material being worked is more easily overcome by to some extent working the surface of the material rather than attempting to thrust into the body of the material.

The frequency of vibration may, when there is no load, be about 30–50 Hertz but is permitted to vary throughout the excavating cycle of the machine 14. The hydraulic motors 36 and 38 are pressure compensated motors of a type obtainable from RHL Hydraulics of Planet Place, Killingworth, Newcastle-upon-Tyne, England in which, as the output torque rises, the output speed falls, thus giving a substantially constant power output. An exemplary motor is Type LM of RHL Hydraulics, Ltd. When in the penetrating mode, that is, when the teeth 56 are initially entering the material to be worked, the load on the motors is relatively low so that the vibration frequency will be relatively high, giving maximum assistance to penetration. As penetration becomes deeper, so the load on the motors becomes relatively great so that the torque demand rises causing a corresponding reduction in the motor speed so that the frequency of the vibration is reduced. This automatic frequency reduction in response to increased load enables vibration to be maintained without stalling occurring, using less power than would otherwise be needed, and hence smaller and lighter motors.

The rotational movement of the bucket 14 about pivot position 34 and the eccentrics 50 also affects the motion described by the teeth 56—the closer that pivot 31 moves towards the eccentrics 50, the greater the length of the longitudinal axis of the motion 58 and vice versa.

Figure 3:
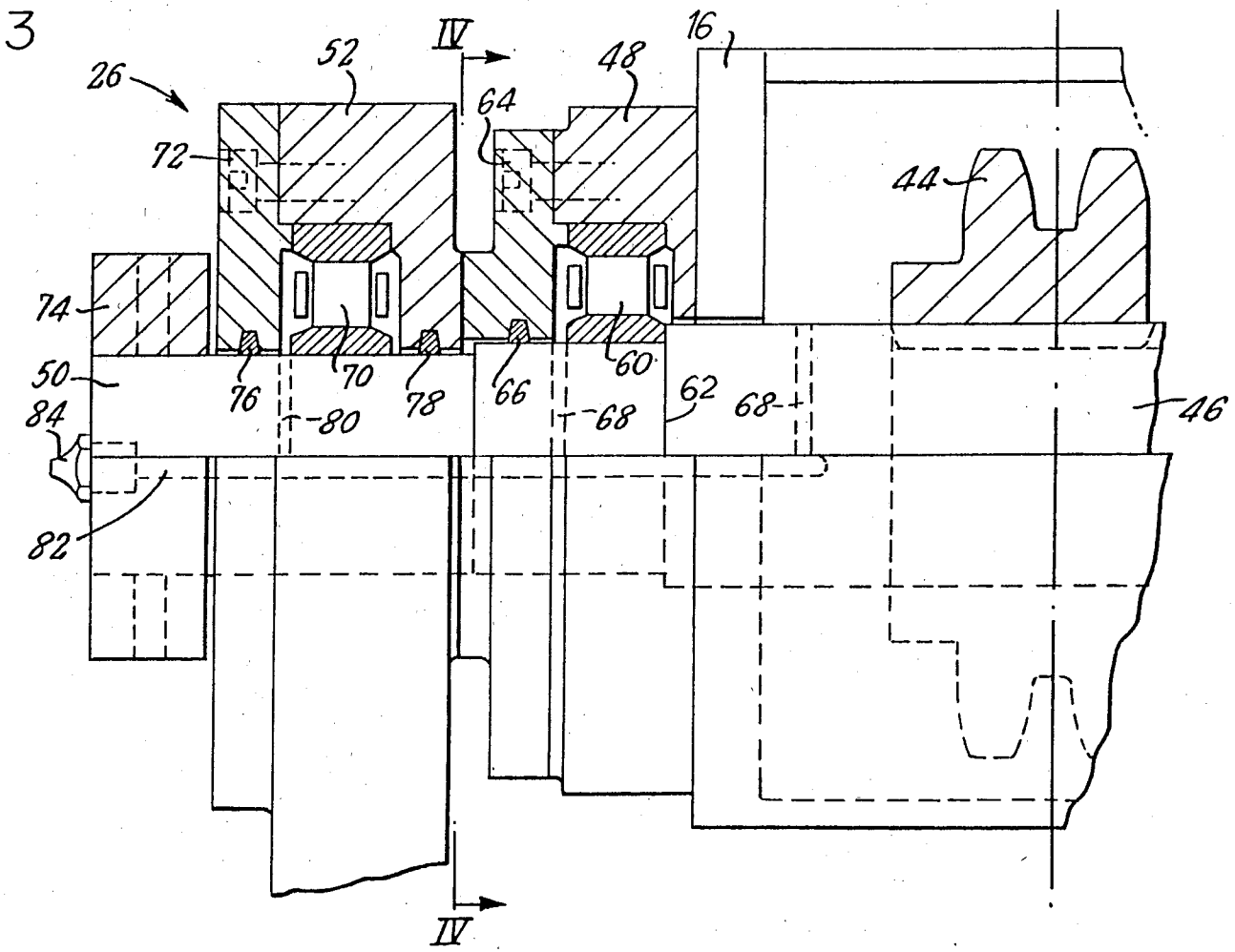
FIG. 3 is a partial cross-sectional view taken along the line III—III of FIG. 2.

Returning now to FIG. 3, the inner bearing housing 48 is bolted to the main support 16 and contains a roller bearing 60 which abuts a shoulder 62 provided in the shaft 46 thereby preventing sideways movement of the shaft 46. A sealing collar 64 is bolted to the housing 48 on the other side thereof and comprises an oil seal 66 to facilitate lubrication of the bearing 60 and the chain 42 via passageways 68 (indicated in dotted lines).

The outer bearing 52 surrounds the eccentric 50 and contains a reciprocating bearing 70. A sealing collar 72 is bolted to the bearing housing 52 and an anti-wear collar 74 is fastened to the end of the eccentric 50 to prevent dirt or water penetration and to facilitate removal of the complete bearing means for servicing. Oil seals 76 and 78 are provided in the bearing housing 52 to retain lubricant introduced through a passageway 80 (shown dotted).

A main lubrication passageway 82 has a grease nipple 84 which is recessed to provide lubrication routes to passageways 68 and 80.

Figure 4:
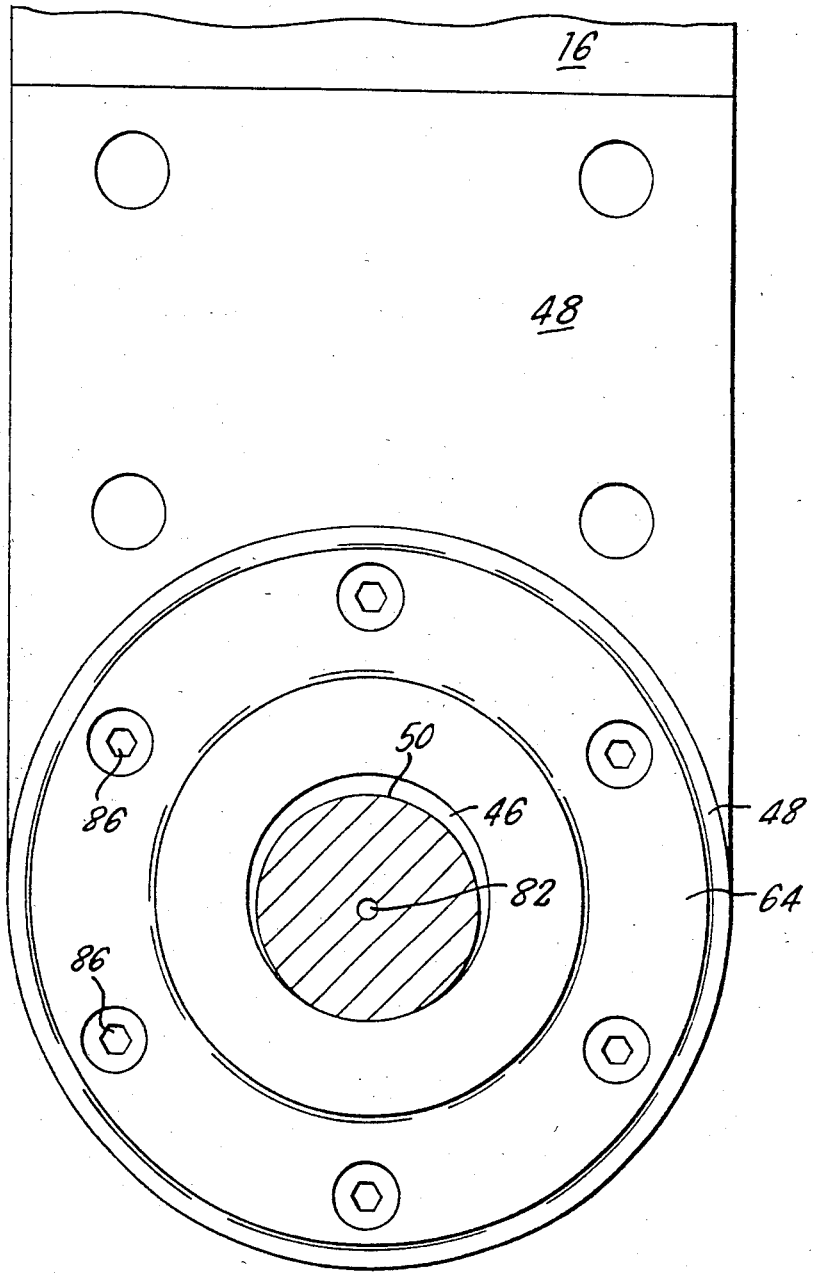
FIG. 4 is a cross-sectional view taken along the line IV—IV in FIG. 3.

In FIG. 4, the position of the eccentric 50 relative to the shaft 46 is illustrated. The eccentric is typically 1 mm. off centre. The bolts 86 fix sealing collar 64 to the bearing housing 48 and the bolts 88 fix the bearing housing 48 to the main support 16. When the motors 36 and 38 operate to rotate the shaft 46 the outer bearing housing 52 is displaced relative to the inner bearing housing 48 by an amount equal to the eccentric radius.

Figure 5:
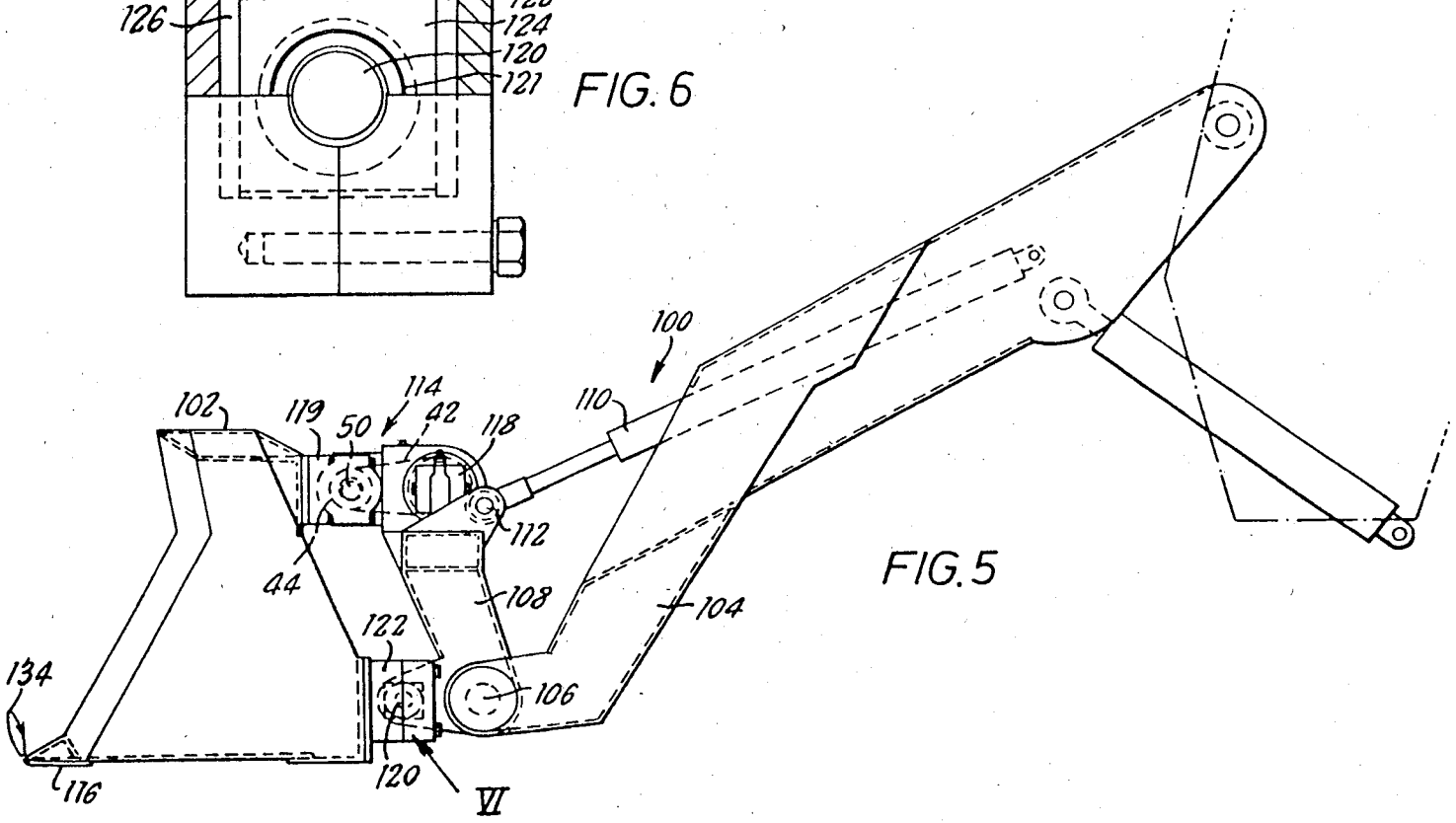
FIG. 5 is a side view of the relevant part of a material working machine including a front loader, which forms a second embodiment of the present invention.

Referring to FIG. 5, front loader mechanism of a material working machine is indicated generally at 100 and comprises a front loader bucket 102 supported by a main support 104. The main support 104 is pivotally connected at 106 to a link member 108 which is in turn pivotally connected to a ram 110 at point 112, the ram 110 being operable to effect rotation of the bucket 102 relative to the main support 104. The machine 100 comprises a vibrating mechanism, indicated generally at 114, for imparting vibratory motion to the tip 116 of the bucket 102 when driven by a motor 118.

Motor 118 vibrates bucket 102 via drive chain 42, sprocket 44 and pivot 46 having an eccentric portion 50 to which the fixed bucket mounting 119 is pivotally mounted by a suitable bearing.

Figure 6:
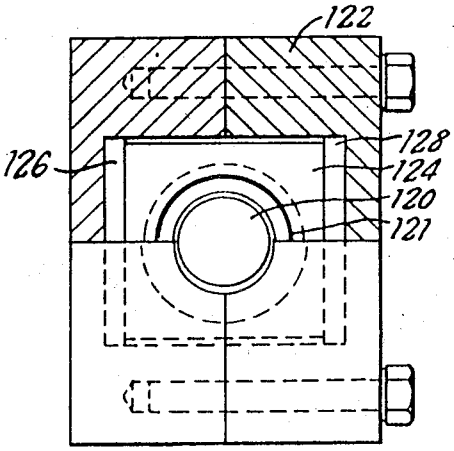
FIG. 6 shows a detail from FIG. 5.

The link member 108 is pivotally attached to the bucket 102 by means of a pivot 120 pivotally mounted in a bearing housing 122 fixed to the bucket as shown in more detail in FIG. 6. The pivot 120 is rotatably mounted by means of a bearing 121 in a bearing block which is slidably retained between rigid plates 126 and 128 so that it can slide up and down in the bearing housing 122. There is an oil duct (not shown) to facilitate lubrication of the pivot 120 and bearing 121. In this way, the circular vibratory movement of the upper end of bucket 102 induced by the vibrating mechanism 114 is accommodated by rocking rotational, and vertical translatory, movement of the pivot 120 in the bearing housing 122. As in the previous embodiment, the movement applied to the bucket from the motors is of a predetermined form established by the mechanical configuration used.

The resultant movement at the bucket tip is an elongate closed path 134 having its major dimension almost perpendicular to the direction in which the toothed leading edge portion of the bucket extends forwardly, which is substantially the same as the direction in which the bucket 102 is pushed (leftwards) by translatory movement into material to be loaded. The loosening effect of this vibration upon the material results in less force being needed to drive a given bucket into a given type of material.

In the embodiments described, improved forms of lubrication are as follows. In FIGS. 1 to 4 sprockets 40 and 44 and chain 42 may be contained in an oil-charged cavity which communicates also with bearings 60, while further oil charged cavities may be incorporated in bearing housing 52 so that oil therein will be splashed or forced at bearings 70 during operation, due to the rapid eccentric movement of the housings. In FIGS. 5 and 6, an arrangement as just referred to may be used to lubricate the vibrating mechanism 114, and bearing housing 122 may have an oil charged chamber therein which communicates with the bearing surfaces of pivot 120 and block 124 to lubricate them.

In both embodiments described above, the eccentric may be driven by any appropriate means, for example an electric motor, instead of a hydraulic motor. The drive means may be articulated to the shaft on which the eccentric is mounted by means of a gear arrangement if desired. It is envisaged that material working machines according to the present invention may be provided with automatic start and cut-off mechanisms, preferably sensing when the implement encounters a substantial load (e.g. by sensing ram pressure) and in response setting the vibration motor or motors running, so that a working implement is vibrated only during the relevant parts of the operation cycle being performed. In addition, a manual override connected to the vibrating mechanism may be provided.

It will be appreciated that, particularly in the FIG. 5 embodiment, the major part of the force to drive or translate the implement, bucket 102, into the material is transmitted on a path through boom 104 and pivots 106 and 120 whereas the vibration is applied on the parallel path of ram 110, pivot 112, pivot 50. Consequently, the vibrating mechanism is not trying to a substantial extent to bodily vibrate the vehicle carrying boom 104 nor the entire body of material bucket 102 is entering, so the power needed to impose the vibration is less than would otherwise be. To the extent that vibration transmitted to the vehicle or other parts of the support means is a discomfort or problem it may be reduced by known vibration absorbing couplings.

Many variations are possible. The motor or motors may drive the eccentric directly. Flywheels may be added to rotating parts to store energy ready for delivery when working of material begins. Other types of implement than a bucket, e.g. an impact-drilling spike or a compacting implement with a flat or rounded base, may be attached to the same support means as have been described and the closed path vibrations imposed on them will enable them to carry out their function. In the case of an impact-drilling spike the closed-path vibrations will reduce the tendency for the implement to become wedged in the hole being made.

In each case, but on a lesser scale, the invention may also be applied to machines which are manually manoeuvred instead of mounted on a prime mover.

Figure 7:
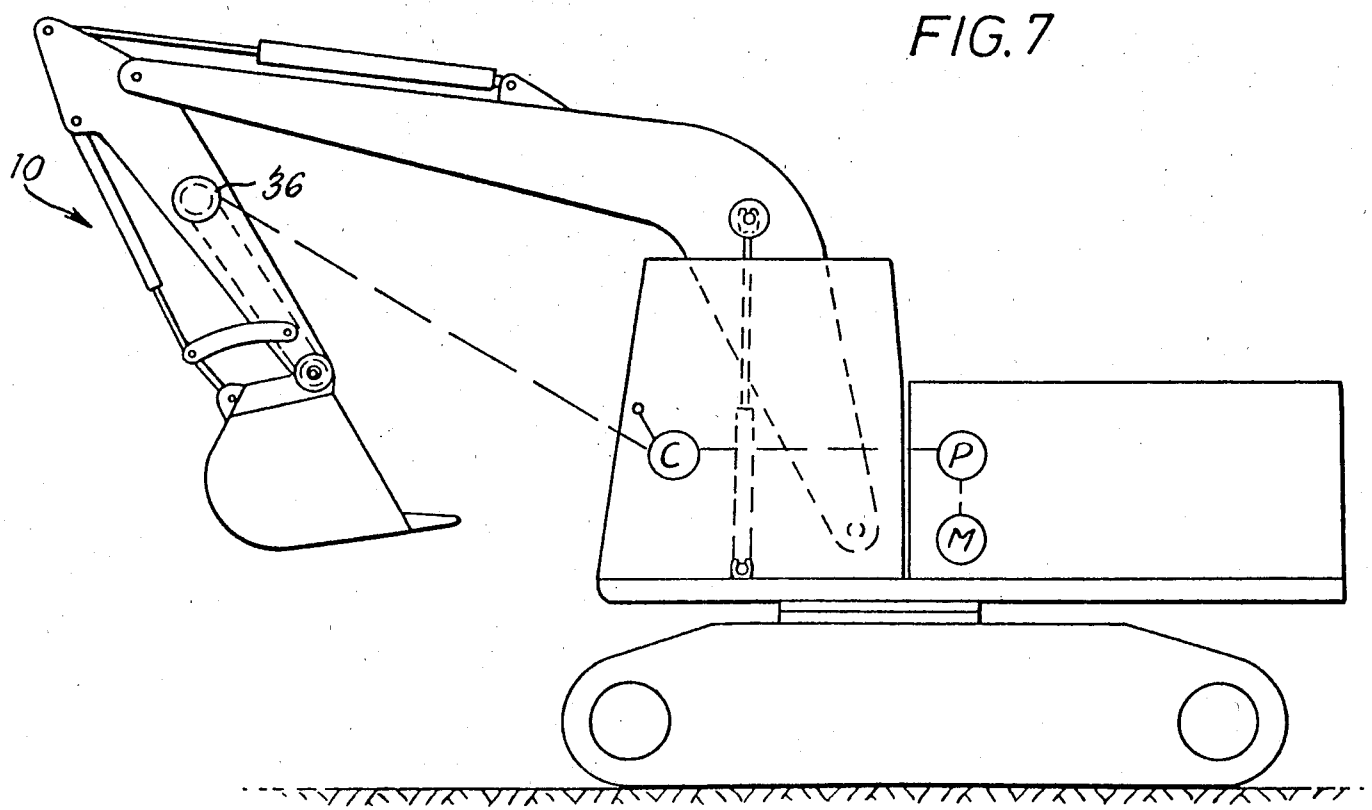
FIG. 7 shows a complete earth moving machine incorporating the excavator of FIGS. 1 and 2.

FIG. 7 shows for the sake of completeness an entire earth moving machine which is conventional except for an excavator arm 10 constructed as described with reference to FIGS. 1 and 2. A main motor M, for example diesel driven, drives a hydraulic pump P which supplies pressurised fluid to a control C which is selectively operable to supply the fluid to the motors 36, 38 to control the vibration of the bucket. The power and control system is diagrammatically shown for simplicity and may be implemented using well known techniques and components.

It will be apparent from the drawings that because the eccentric is closer to the other pivot than is the working portion of the implement, the amplitude of the vibration at the working portion is greater than that applied at the position of the eccentric.

I claim:

1. A material working machine having an implement for working on said material, support means supporting said implement, means for applying non-vibratory forces for the operation of the implement, and separate vibratory means for applying vibratory forces for vibrating the implement such that, in use, a working portion of the implement for engaging said material performs a closed curve motion during each cycle of vibration, wherein the vibratory means is driven by constant-power driving means which automatically responds to any variations in the load applied to the implement at any instant of its operation.

2. A machine according to claim 1, wherein the driving means includes a constant-power hydraulic motor incorporated in a hydraulic circuit independent of any other hydraulic circuit which might be used for the operation of the machine.

3. A machine according to claim 1, wherein the vibratory means both vibrate and pivotally support the working implement.

4. A machine according to claim 1, wherein the vibratory forces are applied along a different path than a major part of the non-vibratory forces.

5. A machine according to any one of claims 1 to 4, wherein mounting of the vibratory means to the implement and mounting of the driving means associated therewith are immersed in lubricant.

6. A machine according to any one of claims 1 to 4, including linkages for effecting non-vibratory movement of the implement to enable selective positioning of the implement.

7. A machine according to claim 1, wherein the vibratory means comprises eccentric means on a shaft.

8. A machine according to claim 7, wherein the eccentric means cooperate with bearing means fixed relative to the implement.

9. A machine according to claim 1, wherein the support means pivotally supports the implement at at least two spaced positions, the vibratory means is arranged to apply vibration to the implement at one said position, and a control member of the support means is pivotally coupled to the implement at another said position so as to control the position of the implement while permitting said vibration.

10. A machine according to claim 9, wherein the control member forms part of a linkage for effecting rotational movement of the implement.

11. A machine according to claim 9 or 10, wherein the control member comprises a link arm movably mounted at both ends.

12. A machine according to claim 9 or 10, wherein the control member is pivotally coupled to the implement by means of coupling units, each containing a pivot received in a bearing reciprocably mounted in a bearing housing.

13. A machine according to claim 4, wherein the support means pivotally supports the implement at at least two spaced positions, the vibratory means is arranged to apply vibration to the implement at one said position and a control member of the support means is pivotally coupled to the implement at another said position so as to control the position of the implement while permitting said vibration.

14. A machine according to claim 13, wherein the control member forms part of a linkage for effecting rotational movement of the implement.

15. A machine according to claim 13 or 14, wherein the control member comprises a link arm pivotally mounted at both ends.

16. A machine according to claim 13 or 14, wherein the control member is pivotally coupled to the implement by means of coupling units, each containing a pivot received in a bearing reciprocably mounted in a bearing housing.

17. A machine according to any one of claims 1 to 4, 7 to 10, 13 or 14, wherein the vibratory means through a gear arrangement are remotely driven by the driving means.

* * * * *